United States Patent [19]

Strobl, Jr.

[11] Patent Number: 4,972,642

[45] Date of Patent: Nov. 27, 1990

[54] FOOTINGS FOR POST OR BEAM CONSTRUCTION

[76] Inventor: Frederick P. Strobl, Jr., 204 N. Shore Dr., Cary, Ill. 60013

[21] Appl. No.: 462,533

[22] Filed: Jan. 3, 1990

[51] Int. Cl.[5] ..... E02D 27/42

[52] U.S. Cl. ..... 52/297; 52/165; 52/298

[58] Field of Search ..... 52/297, 298, 296, 159, 52/165; 47/40.5

[56] References Cited

U.S. PATENT DOCUMENTS

| | | | |
|---|---|---|---|
| 3,302,909 | 2/1967 | Glassman | 47/40.5 |
| 3,691,776 | 9/1972 | Hull | 52/297 X |
| 4,261,138 | 4/1981 | St. George Syms | 47/40.5 |
| 4,269,010 | 5/1981 | Glass | 52/298 X |
| 4,610,356 | 9/1986 | Porter et al. | 47/40.5 X |
| 4,793,110 | 12/1988 | Tucker | 52/297 |
| 4,813,199 | 3/1989 | Lewis, Jr. | 52/297 X |

*Primary Examiner*—Philip C. Kannan
*Attorney, Agent, or Firm*—Staas & Halsey

[57] ABSTRACT

A monolithic plastic moldable foot is provided for supporting a wooden post in a hole in the ground. The foot includes a dish-shaped lower wall configured to be supported by the earth at the bottom of the hole and rib structure on the bottom wall for distributing loads throughout the entire extent of the bottom wall. After the hole is back filled the foot resists lateral and up-loads as well as down loads.

17 Claims, 2 Drawing Sheets

FOOTINGS FOR POST OR BEAM CONSTRUCTION

BACKGROUND OF THE INVENTION

1. Field of the Invention

The present invention relates to footings for posts and particularly to molded plastic footings for wooden posts for structures such as wooden decks and the like.

2. Discussion of the Prior State of the Art

In the past it has been conventional in connection with the building of wooden decks and the like to provide footings for support posts. These footings are generally placed in holes that extend below the frost line to insure solid support throughout the year. In the Northern parts of the contiguous portions of the United States the frost line may be as much as 42 inches below the surface or even deeper. Generally speaking, in the past, the footings have been constructed of concrete.

To conserve concrete, paper tubes known as sonatubes have been inserted in the hole and back filled with earth. Such tubes are approximately 48 inches long and have an inside diameter of about 8 inches. The hollow center core was then filled with concrete, usually from 90 lb. bags carried to the site with great effort. Several bags were required for each footing and since water and mixing are both required to complete quality footings, there were frequent opportunities for serious problems because water is sometimes hard to obtain, the workmen do not always mix the concrete thoroughly, etc. Moreover, freezing conditions require additives to be added to the concrete, providing further opportunity for human error.

A deck with four footings might require as much as a ton of concrete and the typical job site does not provide ample protection from the weather. Inadequate mixing often provides a footing which crumbles prematurely. Additionally, concrete footings are sometimes not resistant to the chemicals often present in ground water and such footings are thus subject to degradation resulting in crumbling and premature failure.

In addition, from a regulatory view point, the use of concrete footings often provides an opportunity for disregarding local zoning and/or constructional requirements. Furthermore, it was often difficult to secure concrete footings in a manner to resist up-loads created by wind lifting.

SUMMARY OF THE INVENTION

The problems outlined above are addressed by the present invention which provides a moldable plastic foot for supporting a post at the bottom of a hole in the ground. The moldable plastic foot of the invention is light weight compared with concrete and is constructed of a material which is impervious to attack by acids and bases. The foot of the invention includes a wall comprising a generally centrally located planar portion and a flange portion that surrounds the centrally located planar portion. The flange portion extends outwardly from the planar portion and the portions each have opposed first and second surfaces. The second surfaces of the portions are configured to rest on the earth on the bottom of a hole in the ground. Preferably the foot may be monolithic structure.

The foot also comprises wall structure on the bottom wall disposed in surrounding relationship to the first surface of the planar portion. The wall structure has inner and outer surfaces and the inner surfaces of the wall structure and the first surface of the planar portion define a pocket configured for receiving and supporting the end of a post. Further the foot of the invention includes elongated rib means on the first surface of the flange portion. The rib means extend laterally outwardly away from the outer surface of the wall structure and interconnect the wall structure and the flange portion to distribute loads imposed on the planar portion and the wall structure throughout the flange portion without substantial deflection of the bottom wall.

In accordance with a preferred embodiment of the invention, the foot includes a peripheral wall that extends around the flange portion and the rib means extends from the wall structure to the peripheral wall. Also in the preferred embodiment of the invention the flange portion of the bottom wall is angularly disposed relative to the planar portion of the bottom wall so that the latter is dish-shaped and has a shape which closely approximates the natural shape of the bottom of a freshly dug hole.

Also in accordance with a preferred embodiment of the invention, the wall structure on the bottom wall may comprise four interconnected side walls that are disposed at right angles to one another such that the pocket is rectangularly shaped, and preferably is essentially in the shape of a square.

Preferably the rib means comprises a plurality of ribs disposed in circumferentially spaced relationship around the wall structure. In this regard, the ribs may each be disposed to extend radially outwardly relative to the center of the square shaped pocket.

In a particularly preferred form of the invention the peripheral wall may be cylindrical and the same may be located to extend around the periphery of the flange portions. And in the preferred embodiment of the invention described in the present application, the rib means may comprise 16 separate ribs.

The foot of the invention may also include tooth means on the second surfaces of the planar and flange portions of the bottom wall for cutting and smoothing the earth at the bottom of the hole in the ground upon rotation of the foot about an axis extending perpendicularly through the plane of the planar portion. Preferably the tooth means may comprise a plurality of teeth, each having a generally triangular cross-sectional configuration presenting a steeply sloped cutting side and a gently slopped smoothing side so that rotation of the foot in one direction results in cutting of the earth at the bottom of the hole and rotation in the opposite direction results in a smoothing of the earth. These operations result in intimate contact between the bottom of the footing and the earth at the bottom of the hole.

In the preferred embodiment of the invention the foot may also include wedge means for insertion between the inner surfaces of the wall structure and the end of a post for compensating for tolerances in 4×4 posts and transferring downward loads from the post to the foot. In addition the foot may include screw means for securing the foot to the end of the post.

DESCRIPTION OF THE PREFERRED EMBODIMENTS

Figure 1:
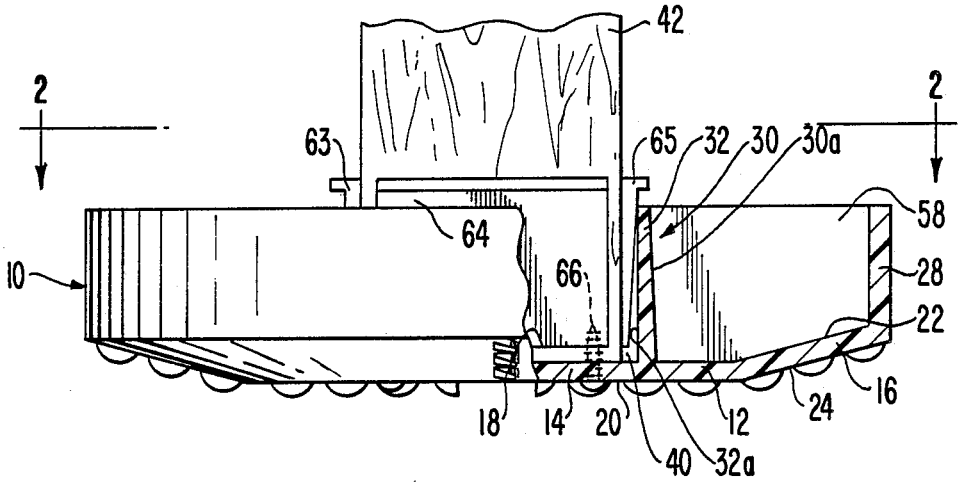
FIG. 1 is an elevational view of a monolithic moldable plastic foot constructed in accordance with the principles and concepts of the invention, portions of the foot having been broken away to reveal internal constructural details.
Figure 2:
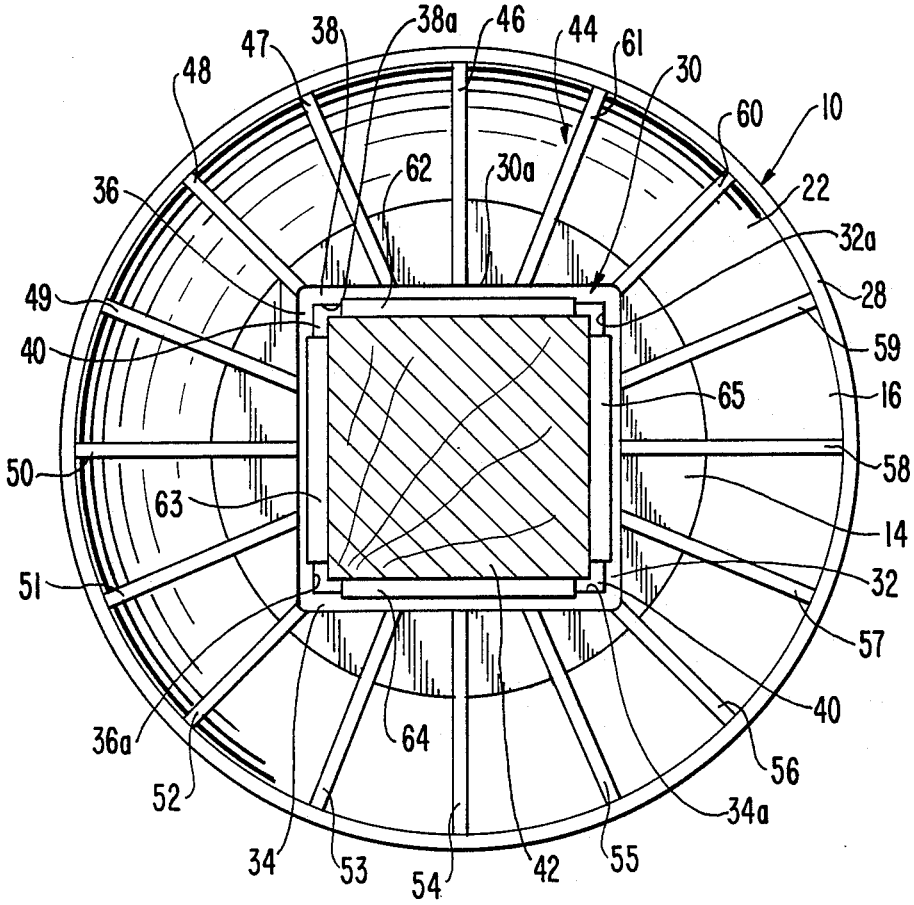
FIG. 2 is a top plan view taken along the line 2—2 of FIG. 1.
Figure 3:
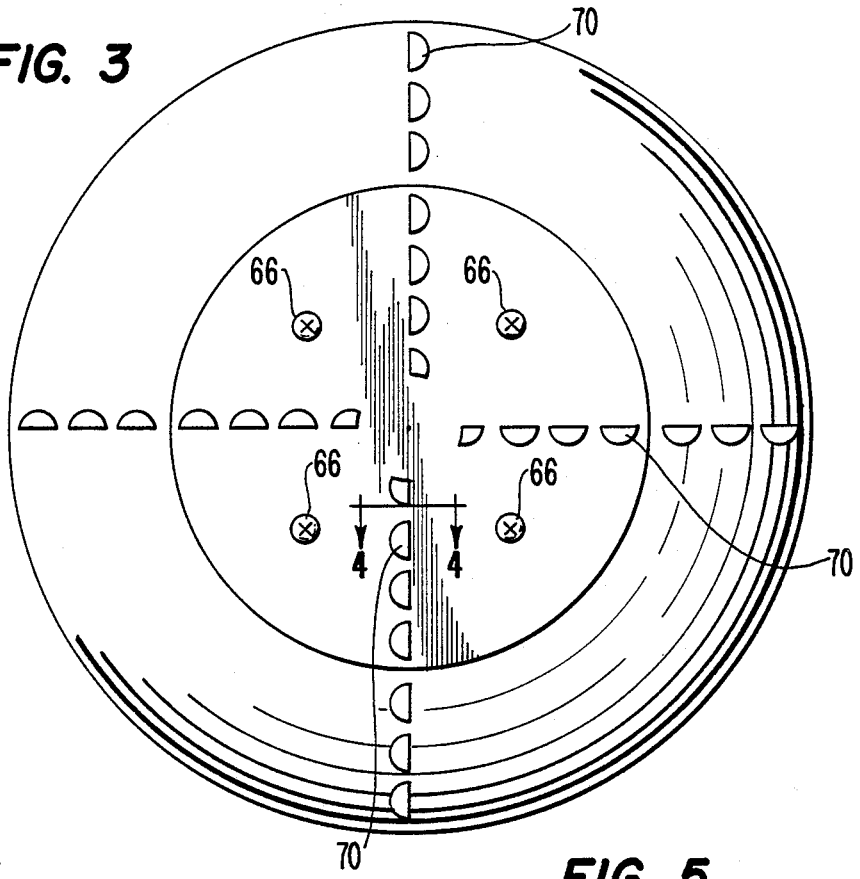
FIG. 3 is a bottom plan view of the foot of FIG. 1.
Figure 5:
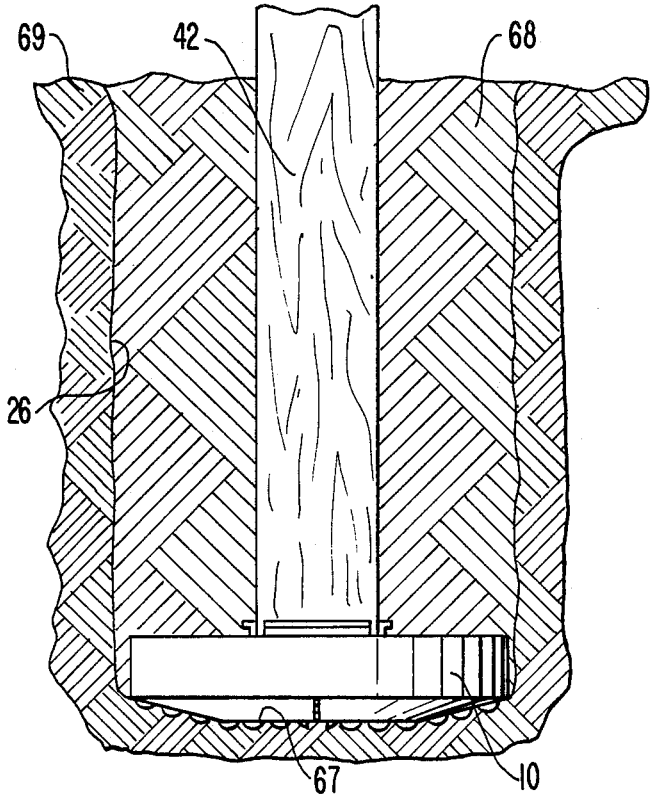
FIG. 5 is an elevational view illustrating the foot of the invention in place at the bottom of a back filled hole in the ground and supporting a post.

A moldable plastic foot 10 which embodies the concepts and principles of the invention is illustrated particularly in FIGS. 1, 2 and 3 of the drawings. Although the foot preferably is monolithic, the same may also be formed from a plurality of pieces that are rigidly secured together to form a unitary construction. The foot has a dish-shaped bottom wall 12 formed from a generally centrally located planar portion 14 and a flange portion 16 that surrounds central portion 14 and is angularly disposed relative thereto. Planar portion 14 has a first surface 18 and a second surface 20, while flange portion 16 has a first surface 22 and a second surface 24. When the foot is in position at the bottom of a hole 26, as shown in FIG. 5, the first surfaces 18 and 22 together form the upper surfaces of bottom wall 12, and the surfaces 20 and 24 together form the lower surface of the foot 10 which is configured to rest on the earth at the bottom of the hole as illustrated in FIG. 5. While the planar portion 14 and flange portion 16 are illustrated as being disposed at a distinct angle relative to one another, it should be understood that the dish-shaped bottom wall 12 could as well be shaped to present a continuous cure without a distinct point of demarcation between portions 14 and 16.

The foot 10 also includes a cylindrical vertical wall 28 located at the periphery of flange portion 16. Additionally, foot 10 includes wall structure 30 formed on bottom wall 12 and disposed in surrounding relationship relative to surface 18 of the planar portion 14. As illustrated wall structure 30 is formed from four interconnected side walls 32, 34, 36 and 38 which are disposed at right angles relative to one another. Walls 32, 34, 36 and 38 have respective inner wall surfaces **32*a*, 34*a*, 36*a* and 38*a* which, together with surface 18 of planar portion 14, define a pocket 40 that is configured to receive the end of a post 42 as illustrated particularly in FIGS. 1 and 2. As shown in the drawings, the walls 32, 34, 36 and 38 are of equal width and therefore pocket 40 is essentially square. However, in accordance with the invention the wall structure 30 may have any number of geometrical shapes to correspond with the shape of a particular post. In this regard, the pocket 40** may be rectangular or round or octagonal, etc.

The foot of the invention includes rib means 44 formed on surface 22 of flange portion 16. Rib means 44 is formed of a plurality of radial ribs 46, 47, 48, 49, 50, 51, 52, 53, 54, 55, 56, 57, 58, 59, 60 and 61 which extend radially relative to the center of planar portion 14 from wall structure 30 to the cylindrical peripheral wall 28. Thus, the sixteen ribs 46 through 61 extend laterally outwardly away from the outer surface **30*a* of wall structure 30 and the same are spaced circumferentially around wall structure 30**.

The foot 10 preferably is constructed of a thermoplastic resin material such as plain or filled polyvinyl chloride materials (PVCs) or polyolefins. While either of these materials and many others can be made to work, as will be appreciated by those skilled in the art, the choice is generally dictated by various building code agencies. Thus, it is possible that a filled PVC material will be approved for a job in the Northeast while a polypropylene material will be required on the West coast. In any event, the material that is used should be one that is impervious to acid or base attack, at least at the acidity or alkalinity levels of ground water.

The base material may preferably be polypropylene and the fillers may be one or several of materials such as glass, talc, minerals, etc. As is well known to those of ordinary skill in the art, fillers are added to a base material such as polypropylene to enhance stiffness (modulus of elasticity), tensile strength and dimensional stability. Generally speaking, the fillers should not affect the chemical resistance of the base material. The foot 10 may ideally be constructed of a transparent or translucent base material so that the contact between bottom wall 12 and the earth at the bottom of the hole can be observed from above.

Preferably the bottom wall 12, peripheral wall 28, wall structure 30 and rib means 44 are formed as a single, integral structure by molding. Thus, the ribs 46 through 61 interconnect the wall structure 30 and the flange portion 16 to distribute loads imposed at the planar portion 14 and wall structure 30 throughout the flange portion 16 without substantial flexing or deflection of bottom wall 12.

Post 42 may be a 0.4 CCA 4×4 wooden post. The 0.4 CCA designation refers to the fact that the post is formed from a pressure treated lumber that retains 0.4 lbs. per cubic foot of chromated copper arsenate after pressure treating. National building codes generally allow such lumber to be installed below grade and such codes are commonly applied for single family home construction in the United States today.

As shown in FIGS. 1 and 2, the end of post 42 is received in pocket 40 and is secured in place within pocket 40 by four wedges 62, 63, 64 and 65 which may be constructed from the same material as the foot 10 and in fact may be molded at the same time in a common mold using conventional molding technology. The wedges 62 through 65 compensate for tolerances in 4×4s and frictionally interconnect post 42 and foot 10 so that downward forces on the post are resisted by wedges 62 through 65 and transferred to walls 32, 34, 36 and 38 which in turn distribute such forces to ribs 46 through 61 to the end that the forces are evenly distributed throughout flange portion 16. In addition, it has been found that if the wedges 62 through 65 are driven into the space between post 42 and the inner surfaces **32*a*, 34*a*, 36*a* and 38*a* of wall structure 30 by hammering, sufficient friction may be achieved to assist in preventing upward forces from extracting post 42 from pocket 40**. The wedges may include "one way" barb or ratchet structure to further prevent extraction by upward forces.

Foot 10 preferably has an outside diameter of 10 inches. Ideally, the dimensions inside pocket 40 are sufficient to accommodate a 4×4 wooden post leaving a space of approximately 3/16 inch on each side to accommodate wedges 62 through 65. Bottom wall 12 and cylindrical wall 28 may preferably each have a thickness of approximately 5/16 of an inch and ribs 46 through 61 may each have a thickness of approximately ¼ of an inch. Finally, the thickness of each of the walls 32, 34, 36 and 38 may be approximately 5/16 inch. At its outer periphery the wall 28 may have a vertical height of approximately $1\frac{5}{8}$ inches and the walls 32, 34, 36 and 38 may have vertical heights above bottom wall 12 of approximately $1\frac{3}{4}$ inches.

For installation the post 42 and foot 10 are first attached to one another, and as can be seen in FIG. 5, the assembly is placed in the hole 26 in the ground. Screws 66 may be used to further secure foot 10 to post 42. These screws are illustrated in FIGS. 1 and 3. Foot 10 rests on and transfers its load to the bottom 67 of hole 26. Hole 26 may then be back filled with fill material 68 to ground level 69. One of the important advantages of the invention, however, is that back filling does not need to be accomplished until the construction of the deck or other load on post 42 is complete. This facilitates inspection procedures, etc. The post 42 rests on and transfers its load to the bottom wall 12 and wall structure 30 of foot 10. The construction of foot 10 then operates to distribute the load uniformly throughout to all portions of bottom wall 12.

A foot 10 having the dimensions described above will experience tensile stresses of only about 1000 psi when withstanding downward loads of 1638 pounds (the maximum load that 3000 psf soil will bear). Further, deflections will be negligible when foot 10 is molded of a standard plain or filled PVC or polyolefin material. Moreover, when a 4×4 post 42 is attached to foot 10 using only two number 10 stainless steel, oval head, sheet metal, $2\frac{1}{2}$ inch screws 66, over 1000 lbs. of uplift resistance is provided. Although as shown the screws 66 are disposed to extend vertically, it should be appreciated that the screws could just as well be disposed to extend through walls 32, 34, 36, 38 in a direction transversely of the longitudinal axis of post 42. In this regard, such transversly extending screws may be disposed to extend perpendicularly to the face of the post or at an angle relative thereto. The foot 10 may also be attached to post 42 by one or more transversly extending pins or bolts (not shown) that extend completely through the post 42 and through aligned holes, for example, in the walls 32, 36 or 34, 38 on opposite sides of the pocket 40. The foot 10 is thus capable of resisting lateral movement and up-loads as well as spreading downward loads at the bottom 67 of the hole 26.

Although the foot 10 as illustrated has a total of 16 ribs, this number may be increased or decreased as needed, depending on the other constructional features of the foot, so as to minimize deflection of flange portion 16 relative to planar portion 14 of bottom wall 12.

Since the foot 10 is intended for installation underground below the frost line, working temperatures will be in the 30° F. to 100° F. range. Chemical resistance should be taken into consideration because ground water is often of unknown acidity, etc. Thus, the materials of construction must simply be such that the foot 10 is impervious to ground water degradation and is non-biodegradable. Selection of an appropriate material is thus well within the skill of the routineer in the art to which the present invention pertains.

Figure 4:
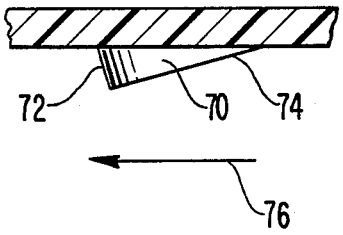
FIG. 4 is a cross-sectional view taken along the line 4—4 of FIG. 3.

In accordance with the invention, the foot 10 may be provided with tooth means in the form of a plurality of teeth 70 configured for cutting and smoothing the earth at the bottom 67 of hole 26 when foot 10 is rotated about an axis perpendicular to planar portion 14 by rotating post 42 about its longitudinal axes while applying a downward force thereto. As illustrated in FIG. 4, each tooth 70 has a triangular cross-sectional configuration presenting a steeply sloped cutting surface 72 and a gently sloped smoothing surface 74. Thus, when tooth 70 is moved by rotation of foot 10 in the direction of arrow 76 in FIG. 4, cutting of the earth at the bottom 67 of hole 26 will occur. Conversely, when tooth 70 is moved in the opposite direction the earth at the bottom 67 of hole 26 will be smoothed by the gently sloping surface 74. It should also be understood that similar teeth could as well be provided on the outer periphery of wall 28 to trim and/or manicure the sides of the hole in the ground.

I claim:

1. A moldable plastic foot for supporting a post at the bottom of a hole in the ground, said foot comprising:

a bottom wall comprising a generally centrally located planar portion and a flange portion that surrounds said centrally located planar portion and extends outwardly therefrom, said portions each having opposed first and second surfaces, said second surfaces being configured to rest on the earth at the bottom of a hole in the ground;

wall structure on said bottom wall in surrounding relationship to the first surface of said planar portion, said wall structure having inner and outer surfaces, the inner surfaces of the wall structure and the first surface of the planar portion defining a pocket configured for receiving and supporting the end of a post; and elongated rib means on the first surface of said flange portion and extending laterally outwardly away from the outer surfaces of the wall structure, said rib means interconnecting said wall structure and said flange portion to distribute loads imposed on the planar portion throughout said flange portion without substantial deflection of the bottom wall.

2. A moldable plastic foot as set forth in claim 1, wherein said foot is monolithic.

3. A moldable plastic foot as set forth in claim 2, wherein is included a peripheral wall extending around said flange portion, said rib means extending from the wall structure to the peripheral wall.

4. A moldable plastic foot as set forth in claim 1, wherein said flange portion is angularly disposed relative to said planar portion so that said bottom wall is dish-shaped.

5. A moldable plastic foot as set forth in claim 1, wherein said rib means comprises a plurality of ribs disposed in circumferentially spaced relationship around said wall structure.

6. A moldable plastic foot as set forth in claim 1, wherein said wall structure comprises four interconnected side walls disposed as right angles relative to one another such that said pocket is rectangularly shaped.

7. A moldable plastic foot as set forth in claim 6, wherein said walls are substantially equal in width such that said pocket is essentially in the shape of a square.

8. A moldable plastic foot as set forth in claim 6, wherein said rib means comprises a plurality of ribs, each rib being disposed to extend radially outwardly relative to the center of said square.

9. A moldable plastic foot as set forth in claim 8, wherein is included a cylindrical peripheral wall extending around said flange portion, said ribs each extending from the wall structure to said cylindrical wall.

10. A moldable plastic foot as set forth in claim 9, wherein said rib means comprises sixteen circumferentially spaced ribs.

11. A moldable plastic foot as set forth in claim 9, wherein said flange portion is angularly disposed relative to said planar portion so that said bottom wall is dish-shaped.

12. A moldable plastic foot as set forth in claim 9, wherein said rib means comprises sixteen circumferentially spaced ribs.

13. A moldable plastic foot as set forth in claim 1, wherein is included tooth means on said second surfaces for cutting and smoothing the earth at the bottom of the hole in the ground upon rotation of the foot about an axis extending perpendicularly through the plane of said planar portion.

14. A moldable plastic foot as set forth in claim 13, wherein said tooth means comprises a plurality of teeth, each tooth having a generally triangular cross-sectional configuration presenting a steeply sloped cutting side and a gently sloped smoothing side so that rotation of said foot in one direction results in cutting of the earth at the bottom of the hole an rotation in the opposite direction results in smoothing of said earth.

15. A moldable plastic foot as set forth in claim 1, wherein said foot includes means for insertion between the inner surface of the wall structure and side surfaces at the end of a post for transferring forces from the post to the wall structure.

16. A moldable plastic foot as set forth in claim 15, wherein said foot includes screw means for securing the foot to the end of a post.

17. A moldable plastic foot as set forth in claim 1, wherein said foot includes screw means for securing the foot to the end of a post.

* * * * *